United States Patent [19]

Easley

[11] Patent Number: 5,067,542

[45] Date of Patent: Nov. 26, 1991

[54] READY-MADE SWAG AND JABOT CURTAIN SYSTEM

[75] Inventor: Madlyn Easley, West Hartford, Conn.

[73] Assignee: Intrascapes, Ltd., West Hartford, Conn.

[21] Appl. No.: 692,829

[22] Filed: Apr. 26, 1991

Related U.S. Application Data

[63] Continuation of Ser. No. 3,547, Jan. 15, 1987, abandoned.

[51] Int. Cl.[5] ..... A47H 1/00

[52] U.S. Cl. ..... 160/126; 160/330

[58] Field of Search ..... 160/126, 123, 330, 348, 160/349, 405, 124, 125, 38, 19, 108, 109, 110, 111, 112

[56] References Cited

U.S. PATENT DOCUMENTS

| | | | |
|---|---|---|---|
| 149,770 | 4/1874 | May . | |
| 1,776,047 | 9/1930 | Shulman | 160/126 |
| 1,956,116 | 4/1934 | Carver | 156/16 |
| 2,194,242 | 3/1940 | Kahn | 160/126 |
| 2,310,014 | 2/1943 | Apfel | 160/35 |
| 2,329,462 | 9/1943 | Friedberg | 160/330 |
| 2,352,531 | 6/1944 | Gallo | 160/330 |
| 2,395,335 | 2/1946 | Loeb | 160/126 X |
| 2,528,652 | 11/1950 | Gundlach | 160/348 |
| 2,547,697 | 4/1951 | Gallo | 160/330 |
| 2,548,879 | 4/1951 | Druck | 160/330 |
| 2,620,027 | 12/1952 | Eisenberg | 160/327 |
| 2,910,120 | 10/1959 | Rosen | 160/84 |
| 3,011,174 | 12/1961 | Schaerer | 160/348 |
| 3,151,345 | 10/1964 | Massop | 160/330 X |
| 3,160,202 | 12/1964 | Rosen | 160/344 |
| 3,321,004 | 5/1967 | Lopes | 160/330 |
| 3,322,182 | 5/1967 | Palella | 160/344 |
| 3,399,711 | 9/1968 | Stulac et al. | 160/330 |
| 3,528,477 | 9/1970 | Abraham | 160/84 |
| 3,593,772 | 7/1971 | Abraham | 160/84 |
| 3,733,227 | 5/1973 | Collins | 160/123 X |
| 3,777,800 | 12/1973 | Susoev | 160/84 R |
| 3,913,655 | 10/1975 | Ogino | 160/84 R |
| 3,952,788 | 4/1976 | Schöler | 160/84 R |
| 3,964,781 | 6/1976 | Fenton | 296/100 |
| 3,999,590 | 12/1976 | Koch | 160/84 R |
| 4,069,857 | 1/1978 | Brookshire | 160/84 R |
| 4,088,170 | 5/1978 | Franklin | 160/84 R |
| 4,397,346 | 8/1983 | Chumbley et al. | 160/84 R |

*Primary Examiner*—David M. Purol

*Attorney, Agent, or Firm*—Ira S. Dorman

[57] ABSTRACT

A ready-made swag and pleated jabot system is provided. The construction is such that installation is facile and yet provides a most attractive window treatment, and the curtain set is ideally suited for sale in pre-packaged condition on a retail basis. An installed, the swag is mounted upon the more rearward of a pair of parallel curtain rods and is draped from that position over the forward rod, to hang in front of the jabots that it supports.

14 Claims, 4 Drawing Sheets

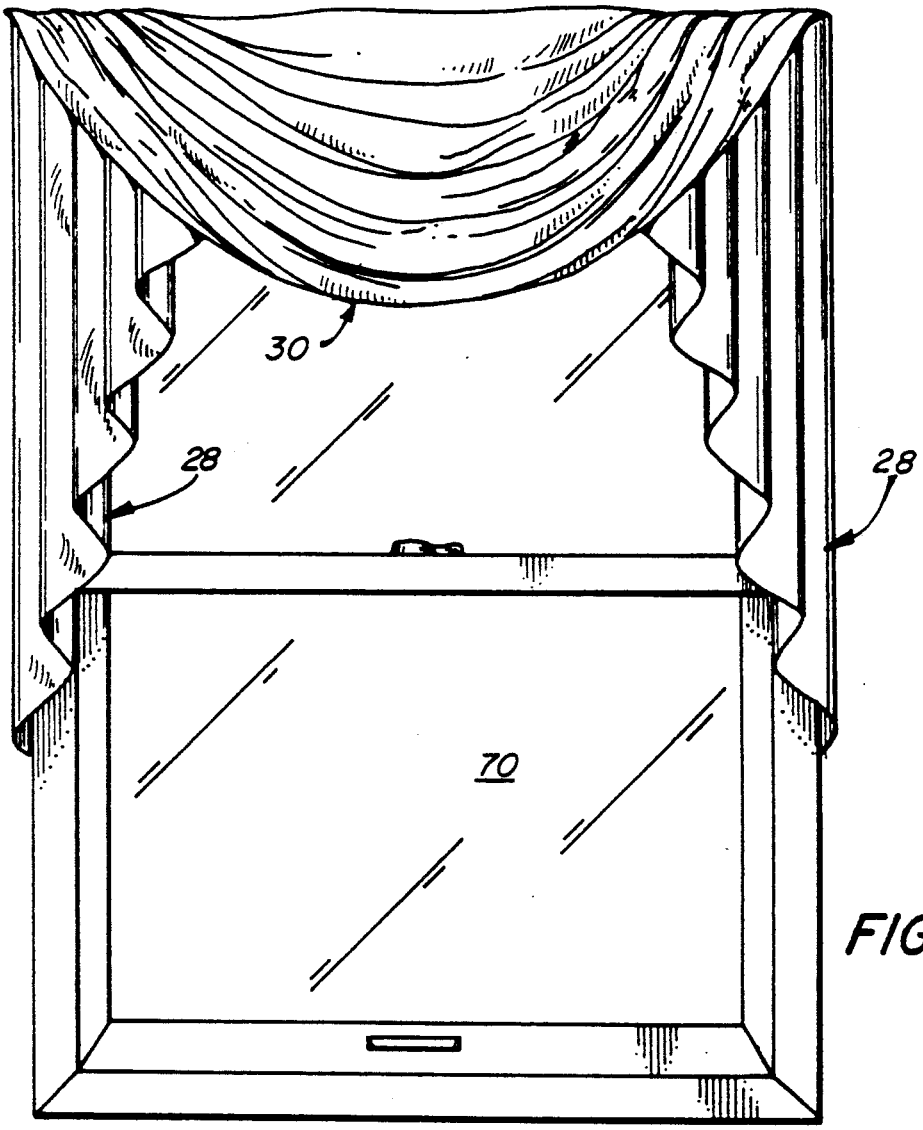
FIG. 7
FIG. 8
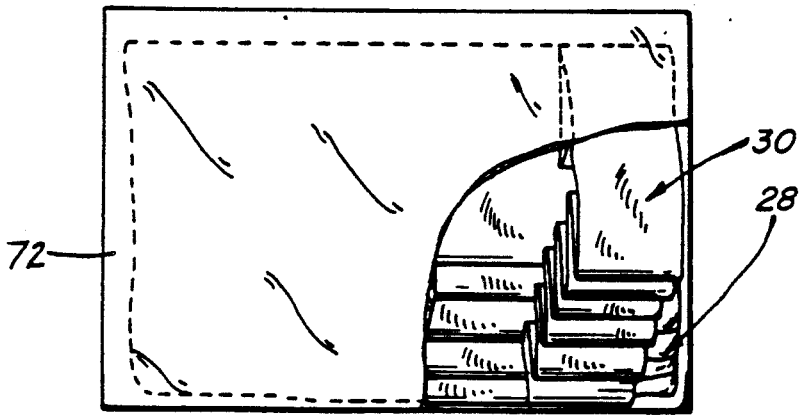

READY-MADE SWAG AND JABOT CURTAIN SYSTEM

This is a continuation of copending application Ser. No. 003,547, filed on Jan. 15, 1987, now abandoned.

BACKGROUND OF THE INVENTION

A style of window treatment that is currently in popular use is known as a "swag and jabot curtain", a typical installation of which is shown in FIGS. 1 and 2 of the appended drawings. At present, such curtain systems are normally custom-made to order and fitted to a particular window; therefore they tend to be quite expensive, they are not adapted for production in volume, and professional installation is generally required.

Accordingly, it is the broad object of the present invention to provide a novel, ready-made swag and jabot curtain set, and a novel system including the same.

It is also an object of the invention to provide such a set and system which are highly attractive, facile to install, positionally stable when hung, and relatively inexpensive to manufacture.

Another object of the invention is to provide a ready-made swag and jabot curtain set which is adapted for sale in packaged condition to the retail market, and for installation by the customer.

A further object is to provide a novel method for the decoration of a window or the like, using a ready-made curtain set.

SUMMARY OF THE INVENTION

It has now been found that certain of the foregoing and related objects of the invention are readily attained by the provision of a curtain system comprising a pair of parallel curtain rods, one mounted behind the other and in substantially the same horizontal plane; a pair of jabots mounted in laterally spaced relationship on the forward rod; and a swag mounted on the rearward rod and draped over the forward one to hang in front of the upper portions of the jabots. Each jabot includes a panel that is folded upon itself and secured in that condition, to provide a multiplicity of permanent lengthwise pleats, and a strip piece fastened against its back surface and joined along the top edge thereof, as well as at a level spaced downwardly therefrom. The strip piece cooperatively provides a laterally extending pocket on the jabot through which the forward rod is received, and a sleeve piece is provided on the swag panel to define a similar pocket for the rearward rod.

Normally, the jabots and swag will be made of a supple fabric, and preferably the tops of the jabots will be substantially free from conspicuous stitching or other fastening elements exposed on the front surface. In especially preferred embodiments the sleeve piece will extend in both lateral directions beyond the swag panel, to cover the return portions of the mounting rod and thereby stabilize the swag panel in a centralized position. Similarly, the seams that join the strip piece to the top of the jabot panels will desirably be disposed on top of the mounting rod, since this will also lend positional stability to the system.

Further objects of the invention are attained by the provision of a ready-made swag and jabot curtain set; by the provision of the set in a package assembly; and by a method for the installation thereof. In these embodiments, the swag and jabot have the features hereinabove described.

BRIEF DESCRIPTION OF THE DRAWINGS

FIG. 7 is an elevational view showing the curtain system installed and employed as a window treatment; and FIG. 8 is a perspective view of a package assembly embodying the invention.

DETAILED DESCRIPTION OF THE ILLUSTRATED EMBODIMENT

Figure 1:
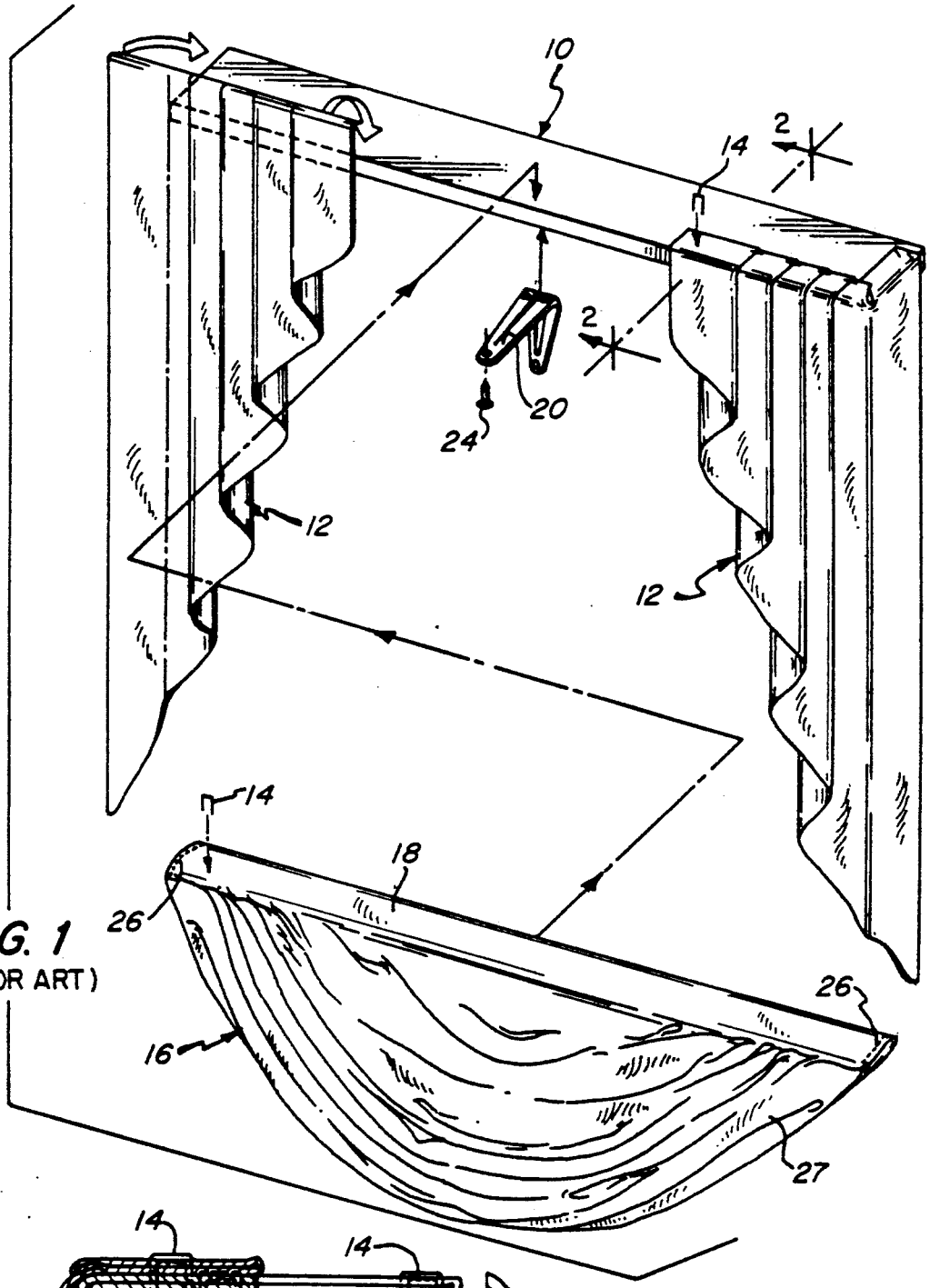
FIG. 1 (PRIOR ART)
FIG. 1 is an exploded perspective view showing the components constituting a typical custom installation of a swag and jabot window curtain treatment.
Figure 2:
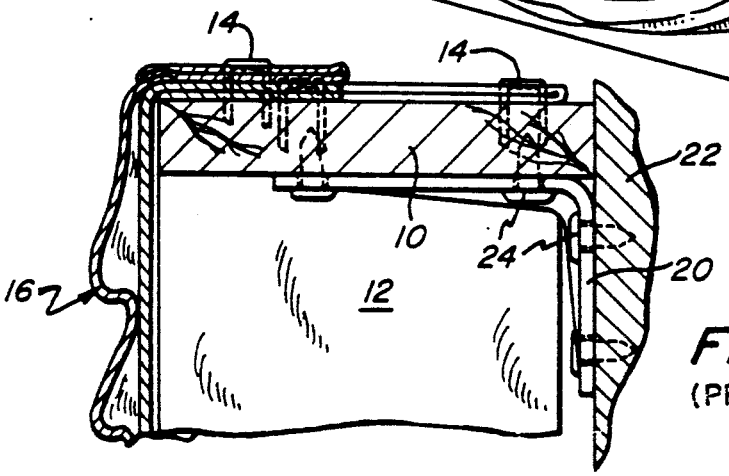
FIG. 2 (PRIOR ART)
FIG. 2 is a fragmentary sectional view of the prior art installation of FIG. 1 with the components assembled, taken along line 2—2 thereof and drawn to an enlarged scale.
Figure 3:
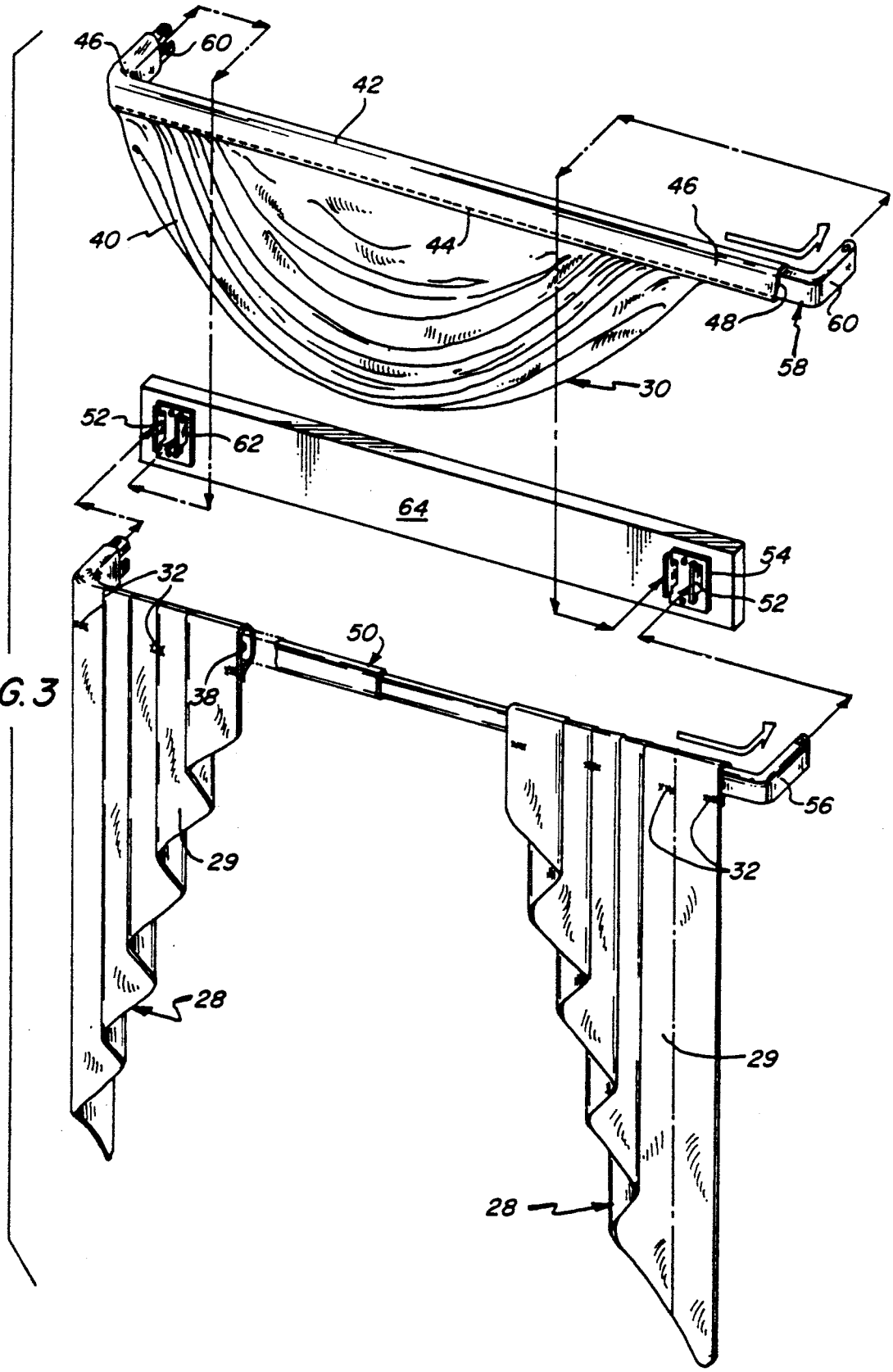
FIG. 3 is an exploded perspective view of a curtain system embodying the present invention, also showing a molding piece and fixtures for mounting the supporting rods.
Figure 4:
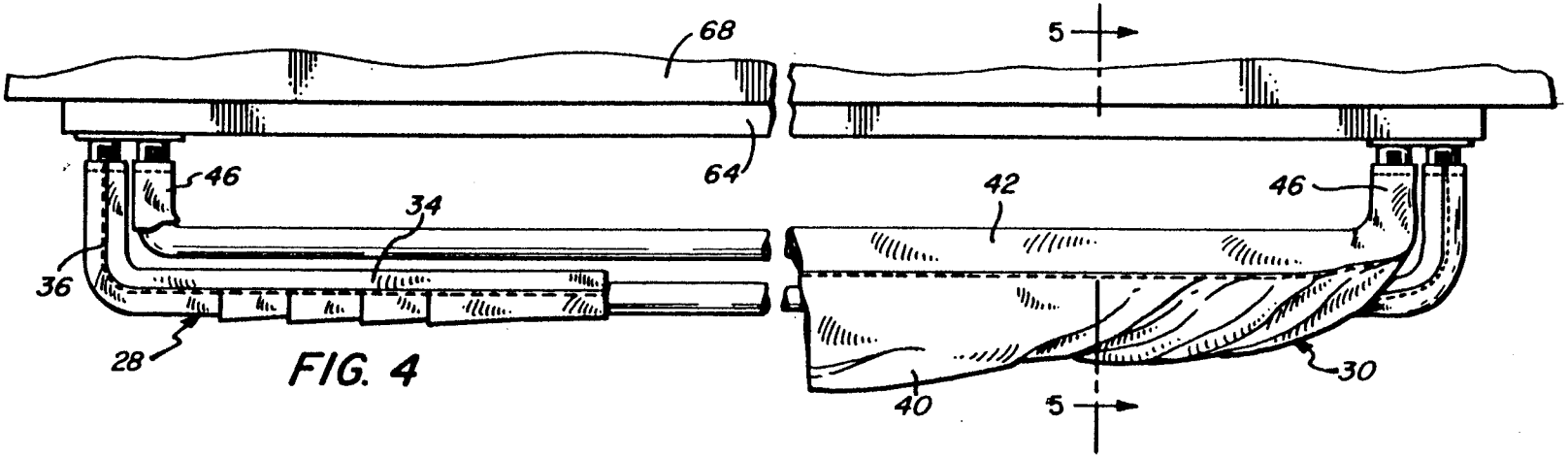
FIG. 4 is a fragmentary plan view of the system of FIG. 3, drawn to a somewhat enlarged scale.
Figure 6:
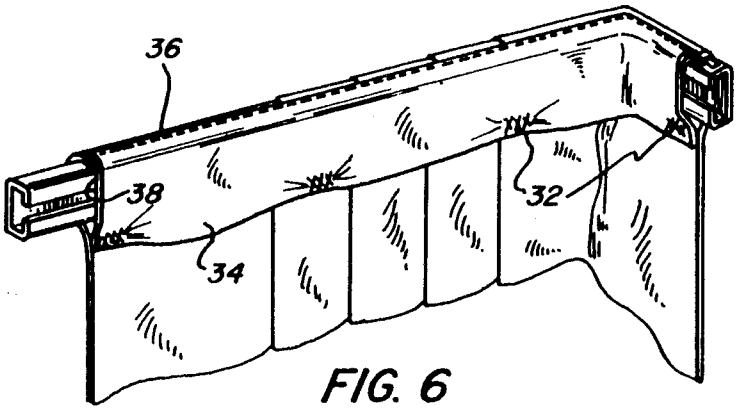
FIG. 6 is a fragmentary perspective view showing the back of the top portion of one of the jabots, and a section of the rod on which it is mounted.

Turning now in detail to the appended drawings, FIGS. 1 and 2 illustrate a conventional custom installation of a swag and jabot window curtain treatment. The arrangement consists of a mounting board 10 to which a pair of jabot panels, generally designated by the numeral 12, are attached. As can be seen, the panels 12 are folded upon themselves to define a series of lengthwise pleats, and they are fastened along the forward and end margins of the board 10 by wire staples 14. The swag, generally designated by the numeral 16, consists of a draped panel 27 attached to a flat, double-ply strip piece 18, which is similarly stapled to the board 10 along the forward margin. The preassembly may then be installed in suitable position in front of a window by supporting the board 10 upon angle brackets 20 (only one of which is shown), which are affixed thereto and to the wall 22 by screws 24. For ease of installation and neatness, the ends of the two-ply strip piece 18 are normally stitched closed, as at 26. FIG. 7 may be considered to illustrate the appearance of both the prior art custom installation and also the system and curtain set of the invention, despite the fundamental differences in their respective constructions.

Turning now in detail to FIGS. 3–6 of the drawings, therein illustrated is a system embodying the present invention. The curtain set consists of a pair of jabots, each generally designated by the numeral 28, and a swag designated by the numeral 30, all made from a supple cloth or fabric. The jabots 28 consist of a panel 29 folded upon itself in a series of lengthwise pleats, which are of permanent form and are maintained by the several short lines of stitching 32, known as "bar tacking", and are virtually unnoticeable as a practical matter. A strip of fabric 34 is fastened to the back of each panel 29, and is secured along its lower edge by the same bar tacking at 32; it is sewn to the top edge of the panel along its opposite margin by a continuous line of stitching at 36. The strip piece 34 cooperates with the panel 29 to form a sleeve-like structure defining an elongated, laterally extending pocket 38. Use of added piece 34 avoids the bulkiness that would result if the pleated panel 29 were merely folded upon itself to produce a pocket, as would not only be unduly cumbersome but would also require more substantial (and therefore more conspicuous) means of securement.

The swag 30 consists of the curved, gently folded hanging piece 40 and the elongated sleeve piece 42, along which the hanging piece 40 is affixed by a line of stitching 44. As can be seen, opposite end portions 46 of the sleeve piece 42 extend laterally beyond the hanging piece 40, and an elongated, open-ended pocket 48 is defined along the entire length thereof.

The swag 30 and jabots 28 are hung on conventional telescoping curtain rods. The jabots 30 are mounted in laterally spaced relationship upon the forward rod, generally designated by the numeral 50, simply by inserting it through the respective pockets 38 and engaging the outer lug 52 of the two fixtures 54 within the open ends of its return portions 56. The swag 30 is similarly supported upon the inner rod, generally designated by the numeral 58, by inserting it through the pocket 48 of its sleeve piece 46. The return portions 60 of the rod 58, which are engaged upon the inner pair of lugs 62, are shorter than the corresponding portions 56, and consequently the sleeve piece 42 is disposed behind the pocket-forming components of the jabots 28, but at the same height. Small nails 66 are used to affix the fixtures 54 to the molding piece 64, which is attached to the wall 68. Such installations are of course commonly used for other styles of curtains and drapes.

Figure 5:
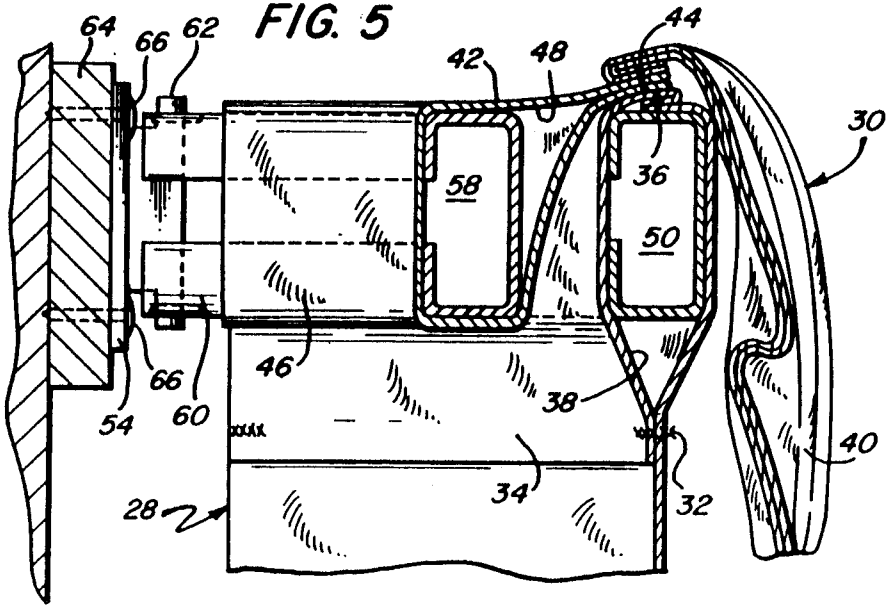
FIG. 5 is a fragmentary sectional view of the system, drawn to a further enlarged scale.

As best seen in FIG. 5, after the swag and jabots have been mounted in the manner described the swag panel 40 is extended forwardly from its mounting rod 58 and draped over the rod 50, to hang in front of the upper portions of the jabots; this produces the arrangement shown in FIG. 7. The swag panel 40 is sufficiently wide to cover the full expanse of the jabots 28 and the space between them, so as to produce a graceful decoration for the window 70, fully as attractive and finished in appearance as are the custom installations. The instant curtain set does so however while also providing the simplicity of manufacture and ease of installation afforded by a ready-made article.

Turning finally to FIG. 8, therein depicted is a package consisting of the swag and jabot set of the invention, further folded into a compact configuration and contained within a plastic bag 72. The manner in which the several pieces are folded to produce the package is of course a matter of relative unimportance, as is the particular kind of container utilized. Rather, novelty of the package assembly resides in the provision of a ready-made swag and permanently pleated jabot set which is adapted to be so packaged.

As indicated above, the various pieces from which the swag and jabot of the invention are constructed will generally be of cloth or supple fabric; however, other materials may be employed, should it be desired to do so. Similarly, the means for fastening the several pieces, and the various portions thereof, will normally constitute lines of stitching, but here again substitutions may be made. Since the upper end portion of the jabots are normally partially exposed in an installation of this kind, it is important in any event that the fastening means employed thereat be quite inconspicuous; bar tacking represents one possibility among the alternatives that will occur to those skilled in the art.

Thus, it can be seen that the present invention provides a novel, ready-made swag and jabot curtain set, and a novel system and method utilizing the same. The curtain set and system are highly attractive, facile to install, positionally stable when hung and relatively inexpensive to manufacture; the curtain set is adapted for sale in packaged condition to the retail market, and for do-it-yourself installation by the customer.

Having thus described the invention, what is CLAIMED is:

1. A curtain system comprising: a pair of parallel curtain rods, one mounted behind the other and in substantially the same horizontal plane; a pair of jabots mounted on the forward rod; and a swag mounted on the rearward rod, said swag including a panel which is draped over said forward rod to hang in front of the upper portions of said jabots, each of said jabots including a panel that is folded upon itself and secured in that condition to provide a multiplicity of permanent pleats extending lengthwise thereof, and a strip piece fastened against the back surface of said folded panel and joined along the top edge thereof and also at a level spaced downwardly therefrom to provide a laterally extending pocket through which said forward rod is received, said pleats extending at least substantially to the upper edge of said forward rod, and said swag further including a sleeve piece on said panel thereof providing an elongated laterally extending pocket through which said rearward rod is received.

2. The system of claim 1 wherein said jabots are substantially free from conspicuous stitching or other fastening elements exposed on the front surface thereof.

3. The system of claim 1 wherein said rearward rod has opposite ends comprised of return portions, and wherein said sleeve piece extends beyond said swag panel in both lateral directions to provide extending portions covering said return portions of said rearward rod, said extending portions thereby serving to stabilize said swag panel in a centralized position thereon.

4. The system of claim 1 wherein said jabots are mounted in laterally spaced relationship to one another, and wherein said swag panel is of sufficient lateral dimension to span said jabots entirely and the space therebetween.

5. The system of claim 1 wherein said strip piece and panel of each of said jabots are joined along said top edge by a seam that is disposed upon and extends along the top of said forward rod, to afford positional stability to said jabots.

6. A ready-made swag and jabot curtain set, comprising a swag and a pair of jabots adapted to be hung on two parallel rods for the cooperative decoration of a window, each of said jabots including a panel folded upon itself and secured in that condition to provide a multiplicity of permanent pleats extending lengthwise thereof, and a strip piece fastened against the back surface of said folded panel and joined along the top edge thereof and also at a level spaced therefrom to provide a laterally extending pocket through which one of the rods may be received, the means for fastening said strip piece at said spaced level being substantially unexposed on the front surface of said panel; said swag including a panel and a sleeve piece extending along one side thereof, said sleeve piece providing an elongated, laterally extending pocket thereacross through which the other rod may be received, and said sleeve piece extending beyond said swag panel in both lateral directions to provide portions for covering return portions on the opposite ends of the rod on which it is mounted, and to thereby stabilize said swag panel in a centralized position thereon, the lateral dimension of said swag panel along said one side being at least equal to the combined widths of said jabot panel along said pockets thereof, so that said swag panel can be draped in front of said jabots to cover the upper portions thereof throughout their full expanse.

7. A method for the decoration of a window or the like, comprising the steps:

(a) providing a ready-made swag and jabot curtain set, comprising a swag and a pair of jabots adapted to be hung on two parallel rods, each of said jabots including a panel folded upon itself and secured in that condition to provide a multiplicity of permanent pleats extending lengthwise thereof, and a strip piece fastened against the back surface of said pleated panel and joined along the top edge thereof and also at a level spaced therefrom to provide a laterally extending pocket through which one of the rods may be received, the means for fastening said strip piece at said spaced level being substantially unexposed on the front surface of said panel, said swag including a panel and a sleeve piece extending along one side thereof, said sleeve piece providing an elongated, laterally extending pocket thereacross through which the other rod may be received, the lateral dimension of said swag panel along said one side being at least equal to the combined widths of said jabot panels along said pocket thereof, so that said swag panel can be draped in front of said jabots to cover the upper portions thereof through their full expanse;

(b) providing and inserting one rod through said pockets of said jabots to dispose them side-by-side thereon;

(c) providing and inserting another rod through said pocket of said swag sleeve piece;

(d) mounting said rods to supporting structure with said one rod in front of said another rod and substantially in the same horizontal plane; and (e) extending said swag panel forwardly over said one rod to drape in front of said upper portions of said jabots.

8. A curtain system comprising: a pair of parallel curtain rods, one mounted behind the other and in substantially the same horizontal plane; a pair of jabots mounted on the forward rod; a swag mounted in the rearward rod, said swag including an elongated pocket extending laterally thereacross, and a panel which is draped over said forward rod to hang in front of upper portions of said jabots, each of said jabots including a panel and a laterally extending pocket along the top of said panel through which said forward rod is received.

9. The system of claim 8 wherein said swag further includes a sleeve piece on said panel providing said elongated pocket.

10. The system of claim 8 wherein said jabots are mounted in laterally spaced relationship to one another, and wherein said swag panel is of sufficient lateral dimension to span said jabots entirely and the space therebetween.

11. A method for the decoration of a window or the like, comprising the steps:

(a) providing a ready-made swag and jabot curtain set, comprising a swag and a pair of jabots adapted to be hung on two parallel rods, each of said jabots including a panel and a laterally extending pocket along the top of said panel through which one of the rods may be received, said swag including a panel and an elongated, laterally extending pocket thereacross through which the other rod may be received;

(b) providing and inserting one rod through said pockets of said jabots to dispose them side-by-side thereon;

(c) providing and inserting another rod through said pocket of said swag piece;

(d) mounting said rods to supporting structure with said one rod in front of said another rod and substantially in the same horizontal plane; and (e) extending said swag panel forwardly over said one rod to drape in front of upper portions of said jabots.

12. The method of claim 11 wherein said swag further includes a sleeve piece on said panel providing said elongated pocket.

13. The method of claim 11 wherein said jabots are mounted in laterally spaced relationship to one another, and wherein said swag panel is of sufficient lateral dimension to span said jabots entirely and the space therebetween.

14. A package assembly including: (a) a ready-made swag and jabot curtain set, comprising a swag and a pair of jabots adapted to be hung on two parallel rods for the cooperative decoration of a window, each of said jabots including a panel folded upon itself and secured in that condition to provide a multiplicity of permanent pleats extending lengthwise thereof, and a strip piece fastened against the back surface of said folded panel and joined along the top edge thereof and also at a level spaced therefrom to provide a laterally extending pocket through which one of the rods may be received, the means for fastening said strip piece at said spaced level being substantially unexposed on the front surface of said panel; said swag including a panel and a sleeve piece extending along one side thereof, said sleeve piece providing an elongated, laterally extending pocket thereacross through which the other rod may be received, and said sleeve piece extending beyond said swag panel in both lateral directions to provide portions for covering return portions on the opposite ends of the rod on which it is mounted, and to thereby stabilize said swag panel in a centralized position thereon, the lateral dimension of said swag panel along said one side being at least equal to the combined widths of said jabot panel along said pockets thereof, so that said swag panel can be draped in front of said jabots to cover the upper portions thereof throughout their full expanse, said jabots and swag being further folded to a configuration of reduced overall dimension for commercial packaging; and (b) a container for said set, said jabots and swag in said further folded configuration being disposed entirely within said container.

* * * * *